US010102781B1

(12) United States Patent
Mitchell et al.

(10) Patent No.: US 10,102,781 B1
(45) Date of Patent: Oct. 16, 2018

(54) RELIGIOUS MESSAGE DISPLAY SYSTEM

(71) Applicants: Robert Mitchell, North Long Beach, CA (US); Mikita Miller, North Long Beach, CA (US)

(72) Inventors: Robert Mitchell, North Long Beach, CA (US); Mikita Miller, North Long Beach, CA (US)

( * ) Notice: Subject to any disclaimer, the term of this patent is extended or adjusted under 35 U.S.C. 154(b) by 0 days.

(21) Appl. No.: 15/697,339

(22) Filed: Sep. 6, 2017

(51) Int. Cl.

| | |
|---|---|
| ***G09F 11/02*** | (2006.01) |
| ***G09F 13/06*** | (2006.01) |
| ***A47G 33/00*** | (2006.01) |
| *G09F 13/04* | (2006.01) |

(52) U.S. Cl.
CPC ..... *G09F 11/02* (2013.01); *A47G 33/00* (2013.01); *G09F 13/06* (2013.01); *G09F 2013/044* (2013.01)

(58) Field of Classification Search
CPC ..... G09F 11/02; G09F 13/04; G09F 2013/044
See application file for complete search history.

(56) References Cited

U.S. PATENT DOCUMENTS 2,798,321 A * 7/1957 Duff ..... G09F 21/046 185/30
4,264,979 A * 4/1981 Gutowski ..... H04B 1/3822 116/263
4,446,810 A * 5/1984 Bressi ..... G09F 11/02 116/307
4,542,604 A * 9/1985 Uihlein ..... G09F 11/02 40/111
5,822,900 A * 10/1998 Armstrong ..... G09F 11/025 40/473
6,178,677 B1 * 1/2001 Williams ..... B60Q 1/503 340/902
6,338,563 B1 * 1/2002 Norman ..... F21L 14/02 362/268
6,401,374 B1 * 6/2002 Bahmad ..... B60Q 1/503 40/564
6,553,697 B1 * 4/2003 Pichan ..... B60D 1/60 40/205
6,789,339 B2 * 9/2004 Blease ..... G09F 21/04 362/503
7,575,349 B2 * 8/2009 Bucher ..... B60Q 1/302 362/231
7,834,752 B2 * 11/2010 Kuvantrarai ..... B60Q 1/44 340/468

(Continued)

*Primary Examiner* — Gary C Hoge
(74) *Attorney, Agent, or Firm* — Ruth Eure

(57) ABSTRACT

A religious message display system for displaying various illuminated and uplifting religious messages through a rear window of a vehicle is provided. The religious message display system comprises a housing having a base wall, a first side wall extending from the base wall, and a second side wall extending from the base wall opposite the first side wall. A light box is rotatably mounted between the first side wall and the second side wall of the housing. At least one religious message is mounted on the light box. An illumination source illuminates the at least one religious message. A power source activates illumination of the illumination source. The light box displays various illuminated and uplifting religious messages viewable to anyone following the vehicle or viewing the vehicle from behind.

5 Claims, 2 Drawing Sheets

(56) References Cited

U.S. PATENT DOCUMENTS

| | | | | |
|---|---|---|---|---|
| 2002/0063686 | A1* | 5/2002 | Schaum | G09F 13/04<br>345/156 |
| 2008/0236006 | A1* | 10/2008 | Chadwell | G09F 13/04<br>40/581 |

* cited by examiner

RELIGIOUS MESSAGE DISPLAY SYSTEM

CLAIM OF PRIORITY

This patent application claims priority under 35 USC 119 (e) (1) from U.S. Provisional Patent Application Ser. No. 62/383,949 filed Sep. 6, 2016, of common inventorship herewith entitled, "Who's On The Lord's Side," which is incorporated herein by reference as though the same were set forth in its entirety.

FIELD OF THE INVENTION

The present invention pertains to the field of vehicular accessories, and more specifically to the field of brake light and display systems that displays various illuminated and uplifting religious messages each time a driver brakes a vehicle.

BACKGROUND OF THE INVENTION

Eye level, rear, third brake lights on motor vehicles have been used extensively in recent years and required by law on all new cars for approximately thirty years. The primary purpose of the third brake light is to attract the attention of the driver of the following vehicle more strongly than what is achievable by the two conventional rear brake lights located lower on the back of the vehicle. The following driver's reaction time is reduced and as a result fewer rear end collisions have occurred and traffic safety has improved.

The back areas of vehicles also are used to display messages and slogans for the attention of the driver of the following vehicle. Such messages usually are placed on bumper stickers, rear window stickers, or on displays placed inside the vehicle on the rear window shelf. In recent years such sticker messages have largely fallen into disuse except at election time.

The prior art has put forth several designs for brake light and display systems. Among these are:

US Patent Publication 2003/0179088 to Peter Heller describes a vehicle symbol illumination apparatus which is operable in conjunction with a high mounted brake light wherein the illumination for the vehicle symbol is extinguished, masked or brightened when the high mounted brake light is activated.

U.S. Pat. No. 5,648,756 to Shlomo Zadok describes a rotatable light box with a number of plane facets consisting of translucent red tinted windows, each of which holds a different transparent strip with a message or graphic. The light box is placed on a rear window shelf of a vehicle. When vehicle brakes are applied, electric lamps attached to a reflector inside a light box illuminate solely a facet and attached message which face rearward where they are seen by a driver in a following car. The number of facets vary from two to eight. A control unit on the vehicle's dashboard is wired to an actuator on the light box to permit the driver to rotate the light box to display different messages. The circuitry illuminates a light panel on the control unit to indicate continuously which message is on display. The indicator light may be turned off by the driver, but will light up every time the brakes are applied. The preferred embodiment uses a solenoid and ratchet type actuator to rotate the light box, combined with a rotary switch for the indicator circuit.

U.S. Pat. No. 4,928,084 to Steven M. Reiser describes a vehicle brake light and display system that employs a display screen having an array of light emitting diodes arranged to transmit a selected pattern or message in red light. A fixed or programmable memory has sets of data stored therein that are selectively extracted to energize certain of the light emitting elements and display a single line of a selected message. Upon actuation of the brake of the vehicle in which the display screen is mounted, display of the message is disabled, and all of the light emitting elements are energized to provide a solid display of red over the entire screen. As a further safety feature, the display is maintained in a disabled condition until initial application of the brake, and subsequent applications of the brake thereafter will cause display of the brake light over the entire display panel.

None of these prior art references describe the present invention.

SUMMARY OF THE INVENTION

It is an object of the present invention to provide a specially configured brake light for automobiles that displays various illuminated and uplifting religious messages each time a driver brakes a vehicle.

The present invention is a religious message display system for displaying various illuminated and uplifting religious messages through a rear window of a vehicle. The religious message display system comprises a housing having a base wall, a first side wall extending from the base wall, and a second side wall extending from the base wall opposite the first side wall. A light box is rotatably mounted between the first side wall and the second side wall of the housing. At least one religious message is mounted on the light box. An illumination source illuminates the at least one religious message. A power source activates illumination of the illumination source. The light box displays various illuminated and uplifting religious messages viewable to anyone following the vehicle or viewing the vehicle from behind.

In addition, the present invention is a method for displaying various illuminated and uplifting religious messages through a rear window of a vehicle. The method comprises providing a housing having a base wall, a first side wall extending from the base wall, and a second side wall extending from the base wall opposite the first side wall, rotatably mounting a light box between the first side wall and the second side wall of the housing, mounting at least one religious message on the light box, illuminating the at least one religious message, for activating illumination of the illumination source, and displaying various illuminated and uplifting religious messages viewable to anyone following the vehicle or viewing the vehicle from behind.

The present invention is a religious message display system for displaying various illuminated and uplifting religious messages through a rear window of a vehicle. The religious message display system comprises a housing having a base wall, a first side wall extending from the base wall, and a second side wall extending from the base wall opposite the first side wall with both the first side wall and the second side wall having a substantially triangular shape, the first side wall and the second side wall having a first edge, a second edge, and a third edge, the first edge mounted to the base wall, an opaque first top wall mounted on the second edge with the first top wall facing into the vehicle, and a transparent second top wall mounted to the third edge with the second top wall facing out of the vehicle. An axle is mounted between the first side wall and the second side wall, the display box rotatably mounted about the axle. A light box is rotatably mounted on the axle between the first side wall and the second side wall of the housing. At least one religious message is mounted on the light box. An illumination source illuminates the at least one religious message. A power source activates illumination of the illumination source. The illumination source is illuminated on application of brakes within the vehicle. The illumination source is illuminated manually separate from the application of brakes within the vehicle. The light box displays various illuminated and uplifting religious messages viewable to anyone following the vehicle or viewing the vehicle from behind.

DETAILED DESCRIPTION OF THE INVENTION

Figure 1:
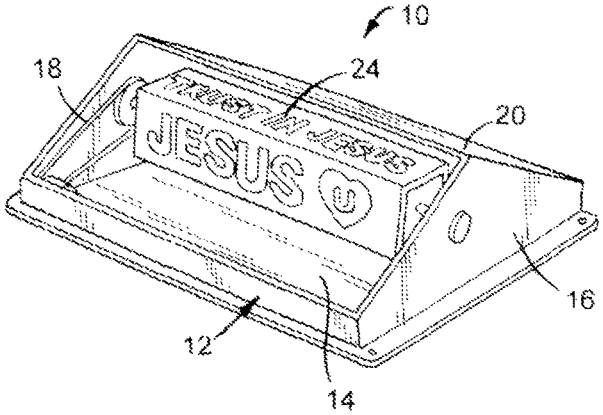
FIG. 1 is a perspective view illustrating the religious message display system, constructed in accordance with the present invention, showing a light box that automatically rotates to display different messages.
Figure 2:
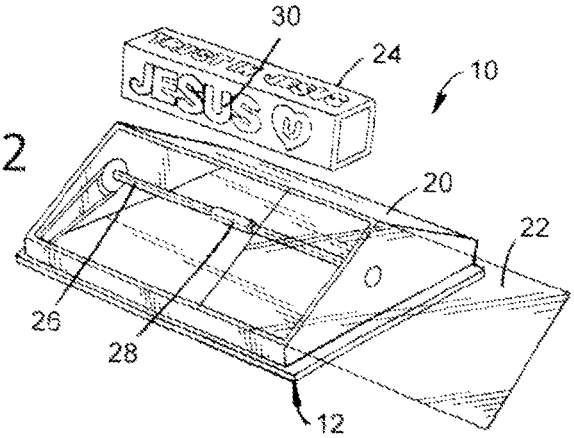
FIG. 2 is another perspective view illustrating the religious message display system, constructed in accordance with the present invention, showing an illuminating light installed on a rod around which the light box resides, and a Plexiglas cover which slips across the front facing area of a triangular holding box and protects the light box from debris.
Figure 3:
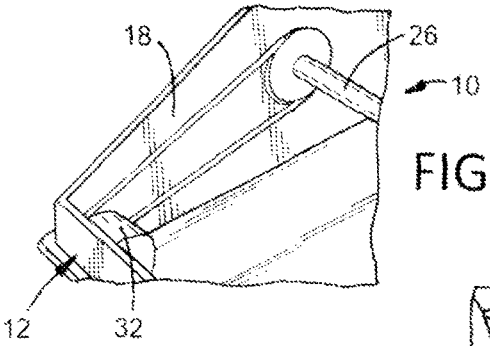
FIG. 3 is a perspective view illustrating a pulley belt and electric motor located inside a corner of a triangular holding box of the religious message display system, constructed in accordance with the present invention.
Figure 4:
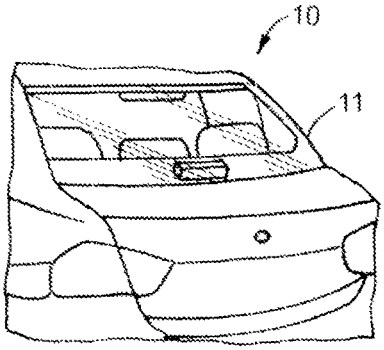
FIG. 4 is a perspective view illustrating the religious message display system, constructed in accordance with the present invention, with the display system operating in the rear window of a vehicle when brakes in the vehicle are applied.

The present invention, hereinafter referred to as a Religious Message Display System, indicated generally at 10, is a specially configured brake light for automobiles that displays various illuminated and uplifting religious messages each time a driver brakes a vehicle. The Religious Message Display System 10 provides encouraging spiritual messages of Jesus's Love to anyone following the vehicle or viewing the vehicle from behind. Retrofitting a third brake light to store and display a selection of messages is a unique functionality that will be highly effective and inspirational in the driving world.

The Religious Message Display System 10 of the present invention includes a housing 12 having a base wall 14, a first side wall 16 extending from the base wall 14, and a second side wall 18 extending from the base wall 14 opposite the first side wall 16. Preferably, the first side wall 16 and the second side wall 18 have a substantially triangular shape with each having a first edge, a second edge, and a third edge. The first edge is mounted to the base wall 14, an opaque first top wall 20 mounted on the second edge with the first top wall 20 facing into the vehicle, and a transparent second top wall 22 mounted to the third edge with the second top wall 22 facing out of the vehicle. In a preferred embodiment, the second top wall 22 is constructed from a Plexiglas material although constructing the second top wall 22 from other transparent materials is within the scope of the present invention.

In addition, the Religious Message Display System 10 of the present invention includes is a light box 24 rotatably mounted on an axle 26 between the first side wall 16 and the second side wall 18 of the housing 12. Either the light box 24 or the axle 26 has an illumination source 28 that illuminates a predetermined or random message 30 or graphic displayed on one of the sides of the light box 24. In a preferred embodiment, the illumination source 28 is a single electric lamp, i.e., a light bulb, although using other illumination sources 28 is within the scope of the present invention. Preferably constructed of a hydro-injected thermoplastic material, the light box 24, mounted within the housing 12, is placed on the rear window shelf of the vehicle 11. When the vehicle brakes are applied, the illumination source 28 attached to a reflector inside the light box 24 or elsewhere illuminates the message 30 which faces to the rear of the vehicle 11 where it is viewable by a driver of a following vehicle.

Figure 5:
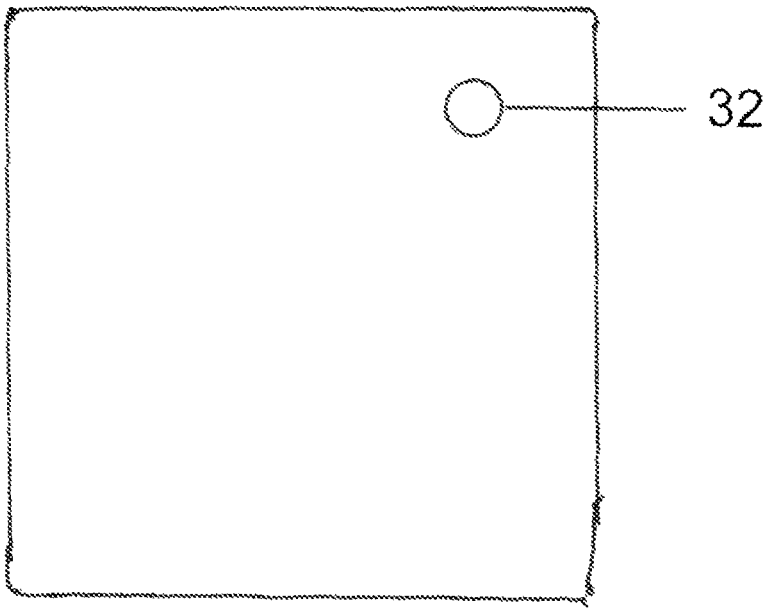
FIG. 5 is a schematic view showing the control component of the present invention.

Additionally, the Religious Message Display System 10 of the present invention includes a control component shown in FIG. 5 positioned and releasably or fixedly mounted on the automobile's dashboard or elsewhere within the vehicle 11 within arm's reach of the driver. The control component is wired to an actuator or motor 32 within the housing 12 or on the light box 24 to permit the driver to rotate the light box 24 to display different messages. In an alternative embodiment, the messages 30 are scrolled by means of an internal scrolling capability. The circuitry illuminates a light panel on the control component to indicate continuously which message 30 is on display. The indicator light 32, shown in FIG. 5 may be turned off by the driver, but will still light up every time the brakes are applied. In still another alternative embodiment, the light box 24 is non-rotatable and mounted by means of brackets.

All circuitry of the Religious Message Display System 10 of the present invention uses the vehicle battery, which usually is twelve volts, as a power source. To accomplish the brake light function, the illumination source 28 of the light box 24 is wired through the vehicle brake switch so that the message 30 on display on the light box 24 is illuminated in red when the driver steps on the brake. A manual override of the light box rotation mechanism enables the light box 24 to be rotated by hand on the rear window shelf when a user wants to change the message transparency.

Among the messages 30 available for broadcast are phrases such as Jesus Saves, Jesus Loves You, and Trust in Jesus. Other available spiritual quotes include Jesus is the Answer, God Is Good, and Blessed. Drivers on the road are emboldened with messages of God while going about their day. These messages subconsciously affect those who see them, improving their attitude or outlook that day. In our stressful world, seeing such uplifting messages are can be therapeutic. Taking a moment to pause and recognize the importance of God's Love in everyday lives is a much needed one. The Religious Message Display System 10 is an innovative way in which to project one's faith in their daily life.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claim.

The invention claimed is:

1. A religious message display system for displaying various illuminated and uplifting religious messages through a rear window of a vehicle, the religious message display system comprising:

a housing having a base wall, a first side wall extending from the base wall, and a second side wall extending from the base wall opposite the first side wall, both the first side wall and the second side wall having a substantially triangular shape, the first side wall and the second side wall having a first edge, a second edge, and a third edge, the first edge mounted to the base wall, an opaque first top wall mounted on the second edge with the first top wall facing into the vehicle, and a transparent second top wall mounted to the third edge with the second top wall facing out of the vehicle;

an axle mounted between the first side wall and the second side wall, the display box rotatably mounted about the axle;

a light box rotatably mounted on the axle between the first side wall and the second side wall of the housing;

at least one religious message mounted on the light box;

an illumination source for illuminating the at least one religious message; and a power source for activating illumination of the illumination source;

wherein the illumination source is illuminated on application of brakes within the vehicle;

wherein the illumination source is illuminated manually separate from the application of brakes within the vehicle;

wherein the light box displays various illuminated and uplifting religious messages viewable to anyone following the vehicle or viewing the vehicle from behind.

2. The religious message display system of claim 1 wherein the indicator light can be turned off, but still illuminates when brakes are applied.

3. The religious message display system of claim 1 and further comprising:

a control component positioned and releasably or fixedly mounted on the automobile's dashboard or elsewhere within the vehicle within arm's reach of the driver.

4. The religious message display system of claim 3 wherein the control component is wired to an actuator or motor within the housing or on the light box to permit the driver to rotate the light box to display different messages.

5. The religious message display system of claim 3 wherein an indicator light panel on the control component is illuminated to indicate which message is on display and wherein the indicator light can be turned off, but still illuminates when brakes are applied.

* * * * *